US005523122A

United States Patent [19]

Harada et al.

[11] Patent Number: 5,523,122

[45] Date of Patent: Jun. 4, 1996

[54] INTERMITTENT COATING PROCESS AND AN APPARATUS THEREFOR WITH ADJUSTMENT OF SPACING BETWEEN COATING ROLL AND ADJUSTER

[75] Inventors: Yoshiro Harada; Kohei Yamamoto, both of Kosai; Kazuhiko Hironaka, Hamamatu; Hiroshi Kobara, Kosai, all of Japan

[73] Assignees: Fuji Electrochemical Co., Ltd., Tokyo; Hirano Tecseed Co., Ltd., Nara, both of Japan

[21] Appl. No.: 302,739

[22] PCT Filed: Jan. 14, 1994

[86] PCT No.: PCT/JP94/00043

§ 371 Date: Sep. 9, 1994

§ 102(e) Date: Sep. 9, 1994

[87] PCT Pub. No.: WO94/15117

PCT Pub. Date: Jul. 21, 1994

[30] Foreign Application Priority Data

Jan. 14, 1993 [JP] Japan ..... 5-004978

[51] Int. Cl.[6] ..... B05D 5/12

[52] U.S. Cl. ..... 427/287; 427/126.1; 427/428; 118/253; 118/249; 118/261

[58] Field of Search ..... 427/287, 126.1, 427/428; 118/247, 249, 253, 261, 263

[56] References Cited

U.S. PATENT DOCUMENTS 4,339,481 7/1982 Beekhuis ..... 118/247
4,485,132 11/1984 Furuzono et al. ..... 118/261
4,603,060 7/1986 Mitsuda et al. ..... 118/261

FOREIGN PATENT DOCUMENTS 58-124264 8/1983 Japan .
62-25260 6/1987 Japan .
1-184069 7/1989 Japan .
1-194265 8/1989 Japan .
4-242071 8/1992 Japan .
4-78349 12/1992 Japan .
6-34958 5/1994 Japan .

*Primary Examiner*—Shrive Beck
*Assistant Examiner*—Katherine A. Bareford
*Attorney, Agent, or Firm*—Wenderoth, Lind & Ponack

[57] ABSTRACT

The distance between a D-roll and a C-roll is switched at proper time intervals between two stages in which the distance is larger or smaller. A thicker coating layer on the C-roll with the thickness controlled by the larger distance between the D-roll and the C-roll is transferred onto a base sheet in a condition in which the C-roll and a B-roll are in contact with each other with the base sheet interposed therebetween. The distance between the C-roll and the B-roll is increased when a thinner coating layer on the C-roll with the thickness controlled by the smaller distance between the D-roll and the C-roll reaches a transfer position, so that the coating layer is not transferred onto the base sheet. A local increase of the amount of the coating material applied at the end of a coating area can be prevented, and the thickness of the coating material applied can be controlled to be constant with high accuracy over the entire coated area.

8 Claims, 3 Drawing Sheets

INTERMITTENT COATING PROCESS AND AN APPARATUS THEREFOR WITH ADJUSTMENT OF SPACING BETWEEN COATING ROLL AND ADJUSTER

BACKGROUND OF THE INVENTION

The present invention relates to a process and an apparatus for coating a slurry coating material onto a continuous base sheet at a given thickness, and particularly to a process and an apparatus for intermittently coating a slurry coating material to alternately form coated and uncoated areas, of predetermined lengths on a base sheet.

In mass production of, for example, a spiral electrode type lithium battery, the following intermittent coating technique is employed. A band-shaped hoop material of a copper or an aluminum foil serving as a current collector of a battery is used as a base sheet, and a slurry mixture containing an electrode active substance as a main component is used as a coating material. The coating material is applied to the base sheet, for example, over an area having a length of 30 cm at a given thickness in such a manner that the coating material is not applied at all to a subsequent area having a length of 5 cm, thereby alternately forming a coated area having a predetermined length and an uncoated area having a predetermined length on the continuous base sheet.

The most typical process used to carry out such an intermittent coating operation employs a coating device referred to as a reverse roll coater as shown in FIG. 7.

Referring to FIG. 7, a coating roll 1 (hereinafter referred to as a C-roll) is rotated at a predetermined speed in a direction indicated by an arrow a. A backing roll 2 (hereinafter referred to as a B-roll) is in contact with the C-roll 1 with a base sheet 3 interposed therebetween and is rotated in a direction opposite from the direction of rotation of the C-roll 1 (i.e., in a direction indicated by an arrow h). The base sheet 3 is allowed to travel in a direction indicated by an arrow c along the B-roll 2 and to pass between the C-roll 1 and the B-roll 2.

An adjuster referred to as a doctor roll 4 (hereinafter referred to as a D-roll) is fixedly (i.e., non-rotatably) mounted above the C-roll 1 and is spaced a predetermined distance therefrom. A coating material 6 accumulated in a hopper 5 is deposited onto a peripheral surface of the C-roll 1 to pass through a region of a minimum distance between the C-roll 1 and the D-roll 4, whereby the amount of coating material 6 applied to the base sheet 3 is controlled to a value (thickness) corresponding to such distance.

A coating layer **6*a* controlled to the predetermined thickness by the distance between the C-roll 1 and the D-roll 4 is transferred onto the base sheet 3 when the base sheet 3 is passed between the B-roll 2 and the C-roll 1. In this manner, a coating layer 6*b* having a controlled constant thickness is continuously applied onto the base sheet 3**.

In order to intermittently form uncoated areas, there is mounted an operating mechanism for moving the B-roll 2 in parallel in a direction perpendicular to a rotational axis thereof. Thus, the B-roll 2 is displaced in a direction indicated by an arrow d at every given time interval, until it is sufficiently spaced apart from the C-roll 1 so that the coating layer **6*a* is not transferred from the C-roll 1 to the base sheet 3. After a lapse of a predetermined time, the B-roll 2 is displaced in a direction indicated by an arrow e back to its original position, and the coating layer 6*a* on the C-roll 1 again is transferred to the base sheet 3**. By repeating such operations, the above-described intermittent coating can be achieved.

However, the above prior art intermittent coating process may suffer from a problem that it is impossible to control the thickness of the coating layer **6*b* in the coated area to a constant value with high accuracy. This is due to the movement of the B-roll 2 during switching from a coating position to an uncoating position. The amount of coating material 6 applied to the base sheet 3 is controlled basically by the distance between the C-roll 1 and the D-roll 4 and the rotational speeds of the C-roll 1 and the B-roll 2. However, the coating material 6 is applied to the base sheet 3 in a manner that the coating layer 6*b* is raised along with the movement of the B-roll 2 away from the C-roll 1, immediately before the coating layer 6*b* applied on the base sheet 3 is discontinued in the transient state of the movement of the B-roll 2 away from the C-roll 1 (in the direction of the arrow d). Consequently, the thickness of a trailing edge of the coating layer 6*b* is locally increased at the end of the coated area, thereby bringing about a very undesirable result. For example, in a mass production line for the above-mentioned spiral electrode type lithium batteries, local drop-off of the coating mixture is liable to occur at the thickened edge of the coating layer 6*b*** at a step of rolling an intermittently coated sheet-shaped electrode, and a current collector of a thin metal foil in such edge portion is excessively rolled, so that it is liable to be broken. In addition, at a step of spirally winding the sheet-shaped electrode along with a separator, a weaving is liable to occur due to the thickened edge. These phenomena may cause hindrances to smooth production. Furthermore, even after completion of assembling of components into a battery, an optimal electric capacity balance between positive and negative electrodes is lost at the thickened edge portions, and particularly, in spiral type secondary lithium batteries the effective utilization of an active material is disturbed. For example, with such secondary batteries, when thickened edge portions are provided only on the side of the positive electrode, the negative side electric capacity may become smaller than that on the positive side and hence, dendrites are liable to be produced in the thickened edge portions on the side of the negative electrode during charging of those batteries, resulting in a problem of short-circuiting between the electrodes.

The present invention has been accomplished under such a technical background, and it is an object of the present invention to provide an intermittent coating process and an apparatus for use therein, wherein a local increase of the amount of coating material applied can be prevented locally at the end of a coated area, and the thickness can be controlled to be constant with high accuracy over the entire coated area.

SUMMARY OF THE INVENTION

To achieve the above object, an intermittent coating process according to a first aspect of the present invention includes depositing a slurry coating material onto a coating roll which is being rotated. The thickness of the coating material on the coating roll is controlled by an adjuster provided at a predetermined distance spaced apart from the coating roll to a value corresponding to the distance. A backing roll disposed in contact with the coating roll with a continuous base sheet interposed therebetween is rotated in a direction opposite from the rotation of the coating roll, allowing the base sheet to travel along the backing roll and to pass between the backing roll and the coating roll. The coating layer deposited on the coating roll with the thickness controlled by the adjuster is tranferred onto the base sheet. Controlling the thickness of the coating material on the coating roll to the value corresponding to the distance includes switching the distance between the adjuster and the coating roll at two stages between larger and smaller values at proper time intevals. Transferring the coating layer on the coating roll onto the base sheet further includes transferring a thicker coating layer on the coating roll with the thickness controlled by the larger distance between the adjuster and the coating roll onto the base sheet in a condition in which the coating roll and the backing roll are in contact with each other with the base sheet interposed therebetween. The distance between the coating roll and the backing roll is increased at a time when a thinner coating layer on the coating roll with the thickness controlled by the smaller distance between the adjuster and the coating roll reaches a transferring position, so that the coating layer is not transferred onto the base sheet.

It is preferable that the coating material deposited onto the coating roll contains an electrode active material as a main component.

It is also preferable that the adjuster used in the step of controlling the thickness of the coating layer on the coating roll to the value corresponding to the distance is a non-rotatable doctor roll.

It is preferable that the base sheet is a metal foil band-shaped hoop material.

It is further preferable that the distance between the coating roll and the backing roll is adjusted by moving the backing roll in parallel in a direction perpendicular to a rotational axis thereof.

Furthermore, an intermittent coating apparatus according to a second aspect of the present invention includes a rotatable coating roll, an adjuster provided at a predetermined distance spaced apart from the coating roll to deposit a slurry coating material onto the coating roll at a thickness corresponding to the distance, a backing roll rotatable in a direction opposite to the direction of rotation of the coating roll in contact with the coating roll with a continuous base sheet interposed therebetween, and a base material supply mechanism for allowing the base sheet to travel along the backing roll and to pass between both rolls, while transferring the coating layer on the coating roll with the thickness controlled by the adjuster onto the base sheet. A first operating mechanism switches the distance between the adjuster and the coating roll between two stages in which the distance is larger or smaller at a proper time interval. A second operating mechanism operated synchronously with the first operating mechanism with a predetermined difference in phase therebetween switches the positional relationship between the coating roll and the backing roll between two stages in which the relationship is a contact or a non-contact state.

According to the intermittent coating process and the apparatus therefor of the present invention, though the backing roll is moved away from the coating roll to form the uncoated area as in the prior art, unlike the prior art, the distance between the coating roll and the adjuster is also varied in order to form the uncoated area. More specifically, so as to form the uncoated area, the distance between the coating roll and the adjuster is first decreased to make the thickness of the coating layer on the coating roll extremely thin. The backing roll is moved away from the coating roll substantially simultaneously with a time when this thinner coating layer reaches the transfer position. This ensures that the coating layer on the base sheet is positively discontinued, so that the trailing edge of the coating layer is not thickened and raised.

If the positional relationship between the coating roll and the backing roll is switched between the two stages in which the relationship is the mutually contact state with the base sheet interposed therebetween or the mutually non-contact state, the coating layer on the base sheet is positively discontinued in parallel to the rotational axis.

DETAILED DESCRIPTION OF THE INVENTION

Figure 1:
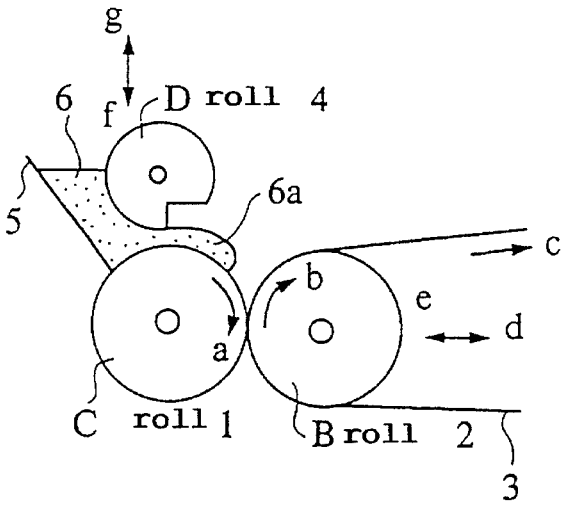
FIG. 1 is a diagram showing the construction and operation of an intermittent coating apparatus according to a preferred embodiment of the present invention and illustrating a first flow stage of an intermittent coating process.
Figure 2:
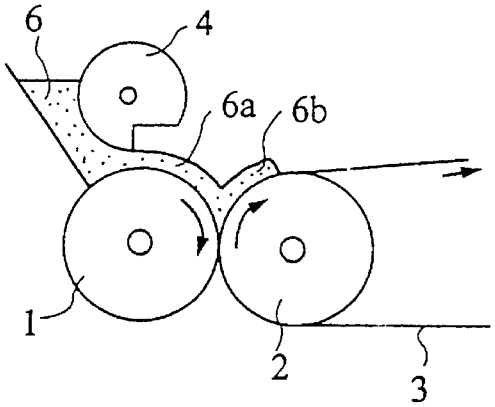
FIG. 2 is a diagram showing the construction and operation of the intermittent coating apparatus and illustrating a second flow stage of the intermittent coating process.

Referring to FIGS. 1 to 6, there are shown an intermittent coating process according to a preferred embodiment of the present invention and an apparatus used in the process. A coating roll (C-roll) 1, a backing roll (B-roll) 2, a base sheet 3, a doctor roll (D-roll) 4, a hopper 5 and a coating material 6 are arranged basically in the same relationship as in the prior art. A coating layer *6a* on the C-roll 1 is transferred to the base sheet 3 to become a coating layer *6b* basically in the same manner as in the prior art.

An operating mechanism displaced the B-roll 2 relative to the C-roll 1 as shown by arrows d–e to switch the positional relationship between the C-roll 1 and the B-roll 2 between two stages in which the relationship is a contact state or a non-contact state. The apparatus of the present invention further includes an operating mechanism for displacing the D-roll 4 relative to the C-roll 1 as shown by arrows f–g to switch the distance or spacing between the C-roll 1 and the D-roll 4 between two stages in which the spacing is larger or smaller.

In a step of forming a coated area, the C-roll 1 and the B-roll 2 are in contact with each other with the base sheet 3 interposed therebetween, and the distance between the C-roll 1 and the D-roll 4 is set at larger value. In this step, the thicker coating layer *6a* on the C-roll 1 with the thickness controlled by the distance between the C-roll 1 and the D-roll 4 is transferred onto the base sheet 3 to form a coating layer having a given thickness.

Figure 3:
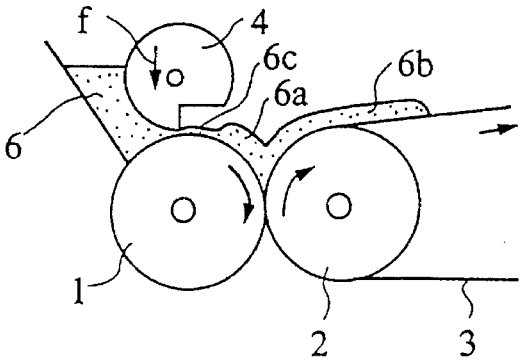
FIG. 3 is a diagram showing the construction and operation of the intermittent coating apparatus and illustrating a third flow stage of the intermittent coating process.
Figure 4:
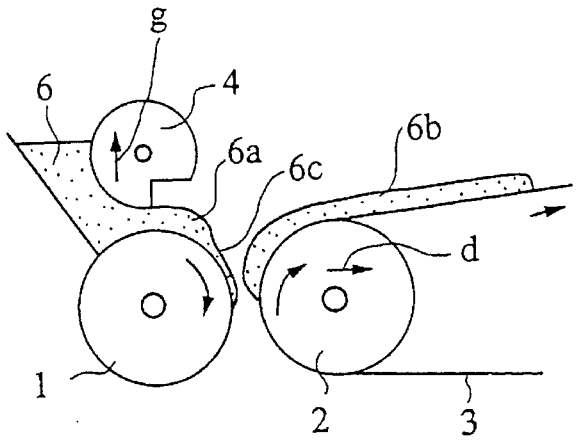
FIG. 4 is a diagram showing the construction and operation of the intermittent coating apparatus and illustrating a fourth flow stage of the intermittent coating process.
Figure 5:
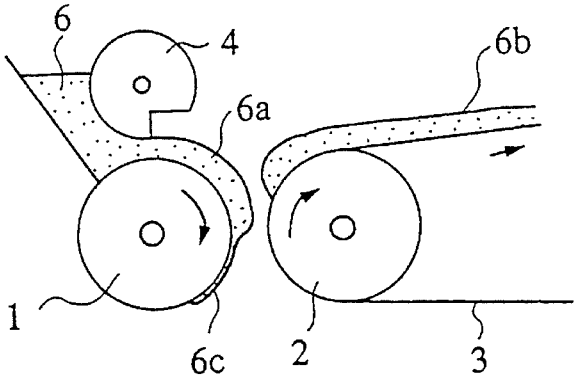
FIG. 5 is a diagram showing the construction and operation of the intermittent coating apparatus and illustrating a fifth flow stage of the intermittent coating process.
Figure 6:
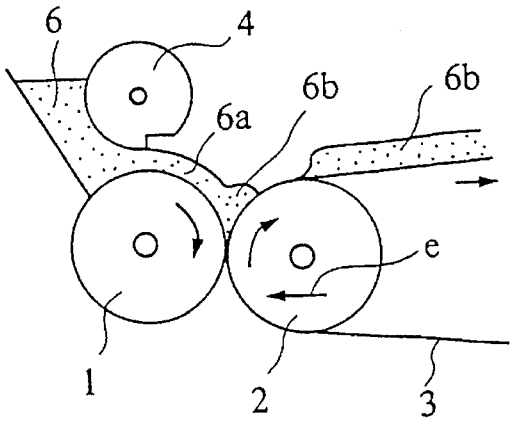
FIG. 6 is a diagram showing the construction and operation of the intermittent coating apparatus and illustrating a sixth flow stage of the intermittent coating process.
Figure 7:
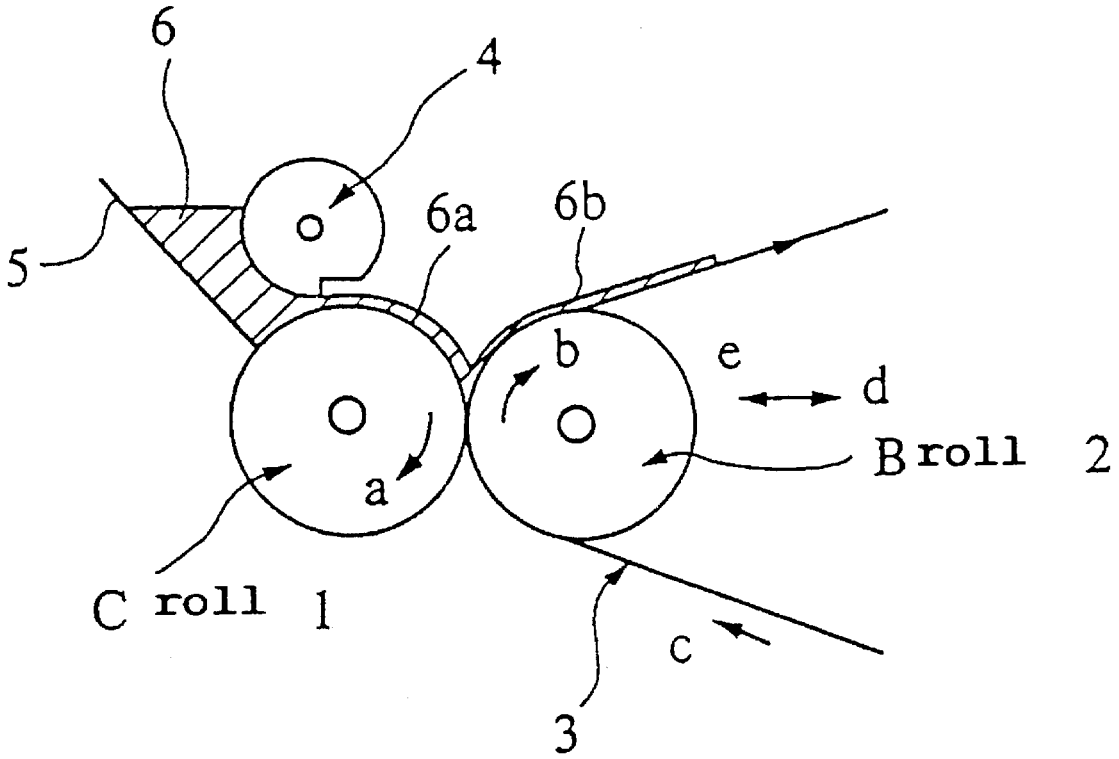
FIG. 7 PRIOR ART
FIG. 7 is a diagram illustrating an intermittent coating process according to the prior art.

In forming an uncoated area, the D-roll 4 is first displaced in the direction of arrow f to decrease the distance between the D-roll 4 and the C-roll 1 as shown in FIG. 3. This operation controls the thickness of the coating layer 6c deposited on the C-roll 1 to an extremely small value. At a in time point when a leading end of this thin coating layer 6c reaches a transferring position, the B-roll 2 is displaced largely away from the C-roll 1 in the direction indicated by the arrow d as shown in FIG. 4. Thereupon, in the transferring position, the B-roll 2 is spaced apart from the C-roll 1 substantially simultaneously with transition of the coating layer on the C-roll 1 from the thicker layer 6a to the thinner layer 6c. Hence, a trailing end of the coating layer 6b on the base sheet 3 is positively discontinued, so that the edge thereof cannot be thickened. It should be noted that before this point in time the D-roll 4 has been displaced in the direction indicated by an arrow g back to an original position in which the distance between the D-roll 4 and the C-roll 1 is larger.

When time is lapsed from the state shown in FIG. 4 to the state shown in 5, an uncoated area having a predetermined length is formed on base sheet 3. When the thicker coating layer 6a then reaches the transferring position again, the B-roll 2 is displaced in the direction indicated by the arrow e into a position in which the distance between the B-roll 2 and the C-roll 1 is smaller. The coating layer 6a on the C-roll 1 is transferred onto the base sheet 3 to restart the formation of a coated area. It should be noted that the fluctuation of the thickness at an edge portion of a leading end of this coated area is far smaller than that of a trailing end of the coated area. Moreover, the shape of the leading end tends to be rounded (i.e., the thickness thereof is gradually decreased), which substantially is not a problem. A desired intermittent coating is performed by repeating the above-described operations.

As discussed above, with the intermittent coating process and the apparatus therefor according to the present invention, the distance between the C-roll and the D-roll is first decreased, thereby extremely reducing the thickness of the coating layer on the C-roll. The B-roll is moved away from the C-roll substantially simultaneously with such thin coating layer reaching the transfer position at which it would be transferred to the base sheet. Thereupon, the coating layer on the base sheet is positively discontinued, so that the edge of the trailing end of the coated area cannot rise or be thickened as in the prior art. Thus, it is possible to alternately form coated areas and uncoated areas on the base sheet with the thickness controlled to a given value with high accuracy.

What is claimed is:

1. An intermittent coating process, said process comprising:

depositing a slurry coating material onto a coating roll which is being rotated;

controlling a thickness of said coating material on said coating roll by an adjuster provided at a distance spaced from said coating roll to a value corresponding to said distance, thus forming a coating layer;

rotating a backing roll disposed in contact with said coating roll with a continuous base sheet interposed therebetween in a direction opposite to the direction of rotation of said coating roll, and allowing said base sheet to travel along said backing roll and to pass between said backing roll and said coating roll;

transferring said coating layer deposited on said coating roll onto said base sheet;

said controlling the thickness of said coating material on said coating roll to said value corresponding to said distance including switching at time intervals said distance between said adjuster and said coating roll between two stages in which said distance is a larger distance or a smaller distance; and said transferring said coating layer on said coating roll onto said base sheet including transferring a thicker coating layer on said coating roll with a thickness controlled by said larger distance between said adjuster and said coating roll onto said base sheet in a condition in which said coating roll and said backing roll are in contact with each other with said base sheet interposed therebetween, and increasing a spacing between said coating roll and said backing roll at a time when a thinner coating layer on said coating roll with a thickness controlled by said smaller distance between said adjuster and said coating roll reaches a transfer position, so that said coating layer is not transferred onto said base sheet.

2. An intermittent coating process according to claim 1, wherein said coating material contains an electrode active material as a main component.

3. An intermittent coating process according to claim 1, wherein said adjuster comprises a non-rotatable doctor roll.

4. An intermittent coating process according to claim 1, wherein said base sheet comprises a band of metal foil hoop material.

5. An intermittent coating process according to claim 1, wherein said increasing said spacing comprises moving said backing roll in parallel in a direction perpendicular to a rotational axis thereof.

6. An intermittent coating apparatus comprising:

a rotatable coating roll;

an adjuster provided at a distance spaced apart from said coating roll to regulate a thickness of a coating layer formed by depositing a slurry coating material onto said coating roll to a thickness corresponding to said distance;

a backing roll rotatable in a direction opposite to a direction of rotation of said coating roll in contact with said coating roll with a continuous base sheet interposed therebetween;

a base material supply mechanism for allowing the base sheet to travel along said backing roll and to pass between said coating and backing rolls, while the coating layer on said coating roll with said thickness controlled by said adjuster is transferred onto the base sheet;

a first operating mechanism for switching at time intervals said distance between said adjuster and said coating roll between two stages in which said distance is a larger distance or a smaller distance; and a second operating mechanism operated synchronously with said first operating mechanism with a phase difference therebetween to switch a positional relationship between said coating roll and said backing roll between two stages in which said relationship is a contact state or a non-contact state.

7. An intermittent coating apparatus according to claim 6, wherein said adjuster comprises a non-rotatable doctor roll.

8. An intermittent coating apparatus according to claim 6, wherein said second operating mechanism switches said positional relationship between said coating roll and said backing roll by moving said backing roll in parallel in a direction perpendicular to a rotational axis thereof.

* * * * *